United States Patent [19]

Matsui et al.

[11] Patent Number: 4,495,682

[45] Date of Patent: Jan. 29, 1985

[54] APPARATUS FOR MAKING ELECTRICAL HARNESSES

[75] Inventors: Minoru Matsui, Tsuyamashi; Yoshihiro Saijyo, Ibaragishi, both of Japan

[73] Assignee: Nippon Acchakutanshi Seizo Kabushiki Kaisha, Japan

[21] Appl. No.: 393,595

[22] Filed: Jun. 30, 1982

[30] Foreign Application Priority Data

Jan. 19, 1982 [JP] Japan ..... 57-7300

[51] Int. Cl.[3] ..... H01R 43/04

[52] U.S. Cl. ..... 29/33 M; 29/564.8; 29/566.3; 29/749

[58] Field of Search ..... 29/564.6, 564.7, 564.8, 29/749, 750, 33 M, 564.3, 566.3, 857, 866, 564.1

[56] References Cited

U.S. PATENT DOCUMENTS

| | | | |
|---|---|---|---|
| 3,672,025 | 6/1972 | Gudmestad | 29/564.6 X |
| 3,848,316 | 11/1974 | Bakermans et al. | 29/564.6 X |
| 3,866,292 | 2/1975 | Tucci | 29/566.3 |
| 4,281,442 | 8/1981 | Senior et al. | 29/757 X |
| 4,367,575 | 1/1983 | Forster et al. | 29/33 M |
| 4,370,806 | 2/1983 | Funcik et al. | 29/749 |
| 4,373,261 | 2/1983 | Long, Jr. | 29/564.6 X |
| 4,403,407 | 9/1983 | Mazzola | 29/564.6 X |

*Primary Examiner*—William R. Briggs

*Attorney, Agent, or Firm*—Antonelli, Terry & Wands

[57] ABSTRACT

An apparatus for manufacturing electrical harnesses, wherein a required number of wires are fed in an equally spaced state to a cutting and wire-to-connector assemblying section at which the wires are cut and separated into two wire groups. At the wire-to connector assemblying section the connectors are affixed to each of the abutting terminals of the wire groups in a single punch and die action. An advancing wire group, which has a connector at the other terminal affixed in a previous process, is released as a finished harness from the apparatus.

11 Claims, 16 Drawing Figures

APPARATUS FOR MAKING ELECTRICAL HARNESSES

The present invention relates to an apparatus for making electrical harnesses which include a plurality of insulating clad wires and contact-type connectors secured to both terminals of the wires, with the contact-type connector including an electrical connector comprising an open top insulating housing, a number of contacts corresponding to that of the wires loaded in the housing, and with each contact having a slot adapted to tightly receive the wire, and wherein when the wire is forced into the slot of the contact, the side ridges of the slot penetrate or extend into an insulation layer of the wire so as to allow the side ridges to reach the conductor embedded in the wire thereby securing electrical connection between the wire and the connector.

The aim underlying the present invention essentially resides in providing an improved apparatus for making electrical harnesses whereby insulation clad wires are fed along the wire feed path during which they are cut to a desired length and provided with connectors at both terminals.

In accordance with advantageous features of the present invention, an apparatus is provided which includes a cutting section and two wire-to-connector assembly sections located in opposite directions with respect to the cutting section. Advantageously, the cutting section includes a cover punch and cutter die disposed above and below the assemblying sections, with a wire-to-connector assembly section including a first presser punch and a die as well as a second presser punch and die, with the punches and the dies being adapted to meet at a point adjacent to a wire feed path.

In accordance with still further features of the present invention, a fixed chuck means is provided for guiding equally spaced wires up to a point adjacent to the cutting section, with a mating movable chuck means being displaceable along the wire feed path. The movable chuck means is adapted to extract the wires for a predetermined or desired length wherein the wires have a connector affixed to their terminals. At this stage of the cutting section, the wires are cut into two separate wire groups the terminals of which are abutting the wire-to-connector assemblying sections, wherein the first presser punch and the die work on the first terminal and the second presser punch and die work on the second terminal so as to secure the connectors to both terminals in a single assemblying working operation. The advancing wire group having terminals at both connections is then released as a finished harness.

In accordance with additional advantageous features of the present invention, the apparatus is provided with a pair of guide plates adapted to move vertically as a unit along the sides of the first presser die and the second presser die, with the guide plates constituting defining walls for the first and second presser dies when the same is fully raised; whereas, when fully lowered, the guide plates are removed from the side of the presser dies.

Additionally, in accordance with the present invention, a pair of auxiliary chucks are provided with one of the chucks being located adjacent to the second presser punch and the other of the auxiliary chucks being located to the second presser die. The auxiliary chucks being adapted to hold equally spaced wires during the cutting and the wire-to-connecting assemblying works and are also capable of vertical movement in association with the raising and lowering of the second presser punch and die.

In accordance with still further advantageous features of the present invention, the first presser punch are arranged such that they descend or are lowered to the wires situated on the wire feed path; whereas, the first presser die and second presser die are raised to a position exceeding or being disposed above the wire feed path thereby allowing the connectors placed on each die to be brought into engagement with the individual wires. In this manner, the individual wires are forced into engagement with each contact housed in the connectors so as to thereby secure and ensure an electrical connection between the wires and the connectors, with the finished harnesses then being released one by one from the apparatus to the receiver.

Accordingly, it is an object of the present invention to provide an apparatus for making electrical harnesses which avoids, by simple means, shortcomings and disadvantages encountered in the prior art.

Another object of the present invention resides in providing an apparatus for making electrical harnesses which ensures the cutting of the harnesses to a desired length and the provision of connectors at both terminals.

Yet another object of the present invention resides in providing an apparatus for making electrical harnesses which is simple in construction and therefore relatively inexpensive to manufacture.

A further object of the present invention resides in providing an improved apparatus for making electrical harnesses which enables the mass production of electrical harnesses on an economical scale.

A still further object of the present invention resides in providing an improved apparatus for making electrical harnesses which is readily adaptable to make such harnesses with wires of a relatively short length.

Yet another object of the present invention resides in providing an apparatus for making electrical harnesses which functions realiable under all operating conditions.

These and other objects, features, and advantages of the present invention will become more apparent from the following description when taken in connection with the accompanying drawings which show, for the purposes of illustration only, one embodiment in accordance with the present invention, and wherein.

Figure 1:
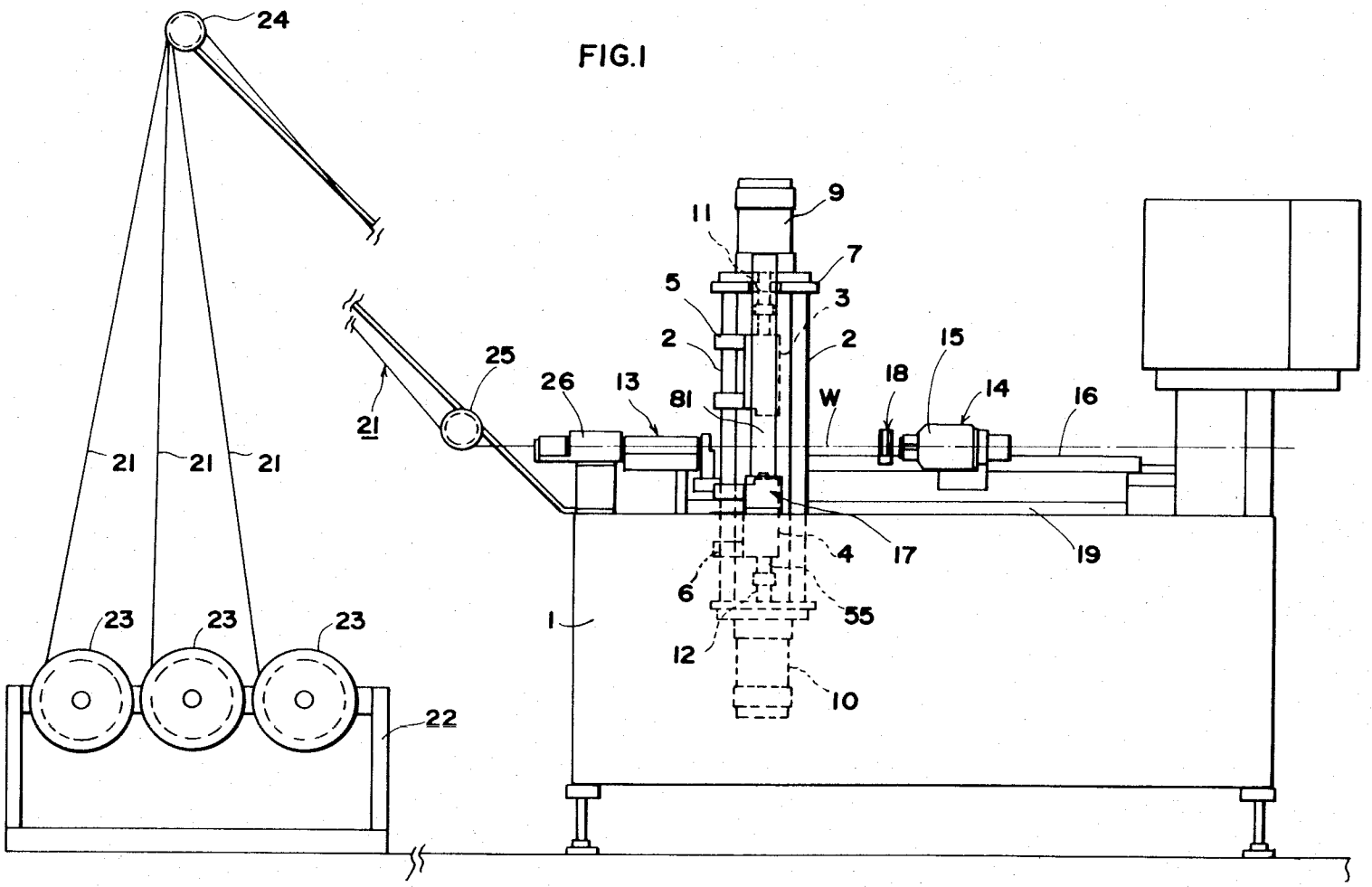
FIG. 1 is a partially schematic front view of an apparatus for making electrical harnesses constructed in accordance with the present invention.

Referring now to the drawings wherein like reference numerals are used throughout the various views to designate like parts and, more particularly, to FIG. 1, according to this figure, an apparatus for producing electrical harnesses includes a body or base 1 having mounted thereon a pair of pillars 2, with the pillars 2 being provided with sliders 5, 6 adapted to be vertically displaceable along the pillars 2. The slider 5 moves in an upper section of the pillars 2 with the slider 6 moving in a lower section thereof. The slider 5 is provided with a punch block 3 while the slider 6 has mounted or carries a die block 4. The raising or lowering of the slider 5 is effected by hydraulic or pneumatic cylinders 9 which, in the illustrated embodiment, includes a piston rod 11 connected to the punch block 3. The raising and lowering of the slider 6 is also effected by either a pneumatic or hydraulic cylinder 10 which, in the illustrated embodiment, includes a piston rod 12 connected to the die block 4. The pneumatic or hydraulic cylinders 9, 10 are respectively arranged on supports 7, 8.

A fixed chuck generally designated by the reference numeral 13 is disposed adjacent to the left hand pillar 2, with the fixed chuck 13 being adapted to guide a plurality of insulation clad wires, hereinafter referred to merely as wires, along a wire feed path W which extends longitudinally of the body or base 1. The punch block 3 and die block 4 are disposed in opposition to each other with the wire feed path W extending therebetween.

The fixed chuck 13 is cooperable with a mating chuck generally designated by the reference numeral 14 movable along the wire feed path W. The mating chuck 14 is carried on a chuck body 15 which is slidably mounted on a rail 16, with the movement of the chuck body 15 being effected in a conventional manner.

Connectors 20 (FIG. 6) are supplied in two rows from a magazine housed in a connector supply unit generally designated by the reference numeral 17. The connectors 20 in one row are pushed onto one die in the die block 4 and the connectors 20 in the second row are pushed into another die provided in the die block 4. Finished harnesses are discharged through a discharge cylinder generally designated by the reference numeral 18, with the discharged harnesses being received on or by a receiver 19.

Figure 2:
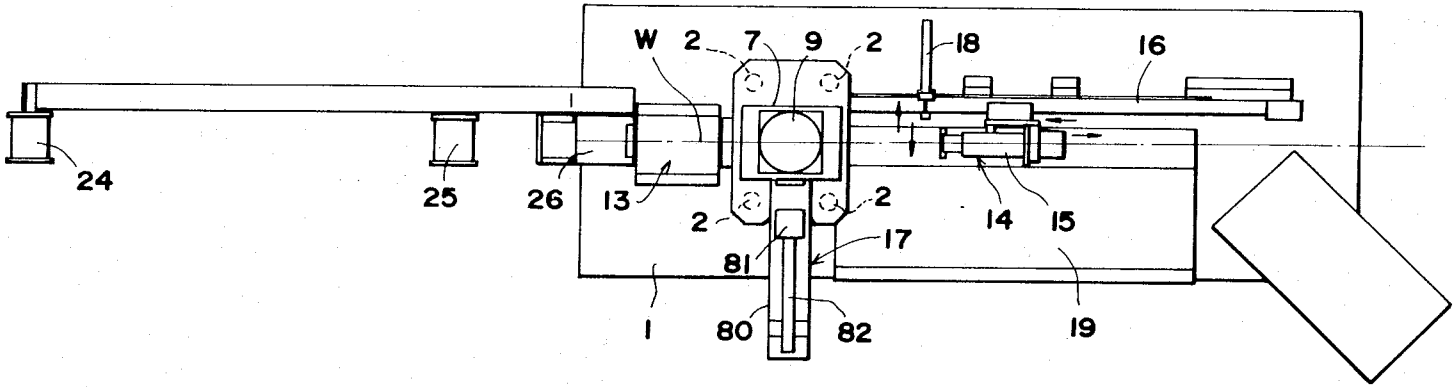
FIG. 2 is a top plan view of the apparatus of FIG. 1.

One wire group 21 to be connected to one connector includes a plurality of lines of wires which are individually wound on reels 23 mounted on a rack 22. As shown most clearly in FIGS. 1 and 2, the wire group 21 is fed to a straightener 26 through guide rollers 24, 25 whereby the wires as a whole are straightened. The wire group 21 is further fed along the wire feed path W to the fixed chuck 13, which is explained more fully hereinbelow.

Figure 3:
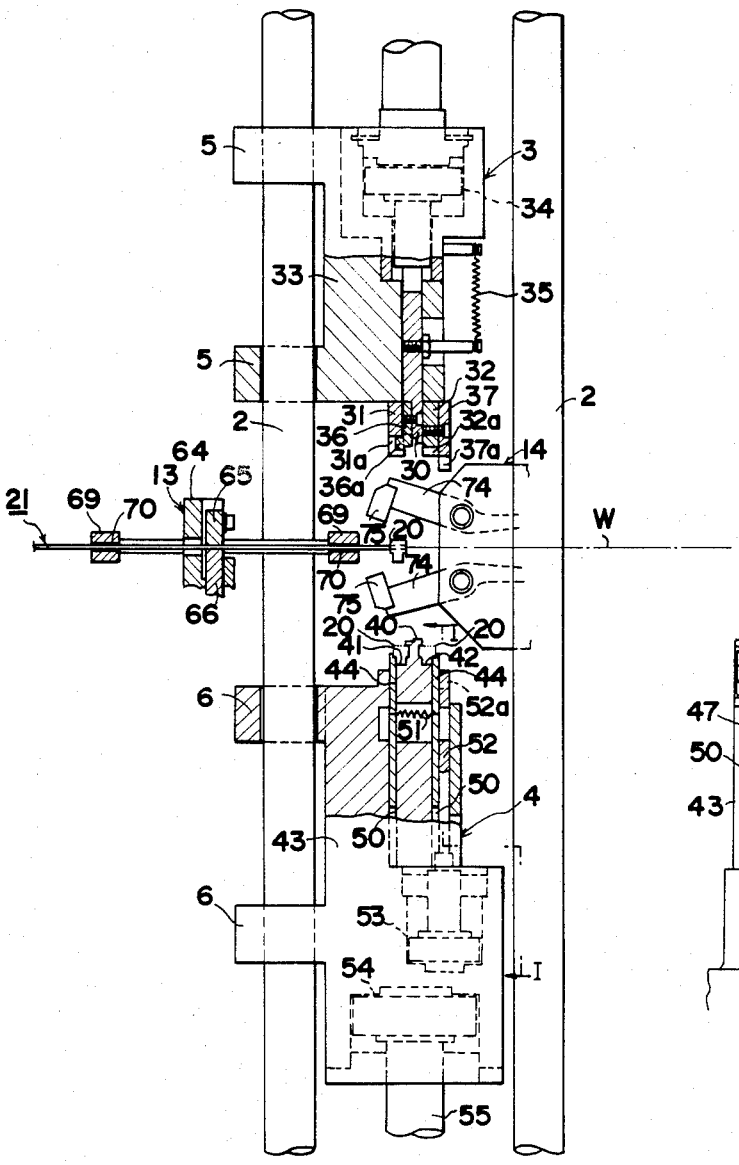
FIG. 3 is a partial cross sectional view, on an enlarged scale of a cutting section and wire-to-connector assemblying section of the apparatus of FIG. 1.
Figure 4:
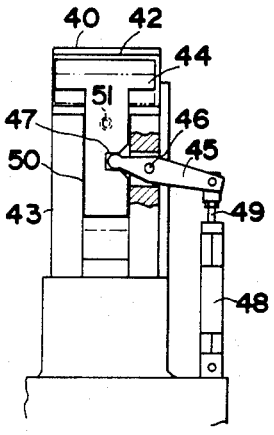
FIG. 4 is a cross sectional view taken along the line I—I in FIG. 3.

FIGS. 3 and 4 provide an illustration of the wire cutting section and wire-to-connector assemblying section of the apparatus of the present invention. As shown in these figures, a cutter punch 30, a first presser punch 31, and a second presser punch 32 are provided, with the two presser punches 31, 32 being disposed in opposite directions with respect to the cutter punch 30. The presser punches 31, 32 each include comb-like toothed blades 31*a*, 32*a*, respectively, which blades are adapted to punch the wires 21 individually by their toothed ends. The presser punches 31, 32 are secured to a punch holder 33, with the cutter punch 30 being carried on the punch holder 33 in such a manner that it may be raised and lowered along the punch holder 33. The cutter punch 30 is connected to a hydraulic or pneumatic cylinder 34 mounted on the punch holder 33 so as to allow the same to be lowered under a pneumatic or hydraulic pressure. The raising of the cutter punch 30 is carried out by a spring 35 and, normally, the cutter punch 30 is raised or assumes the position shown in FIG. 3 under the action of the spring 35.

Figure 14:
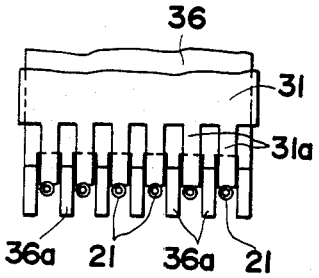
FIG. 14 is a cross sectional view taken along the line II—II in FIG. 9.

The cutter punch 30 includes a wire guide 36 which is adapted to move upwardly and downwardly with the cutter punch 30. The wire guide 30 includes a comb-like guide plate 36*a* with each tooth of the comb-like guide plate 36*a* being adapted to prevent the wires from becoming displaced sideways and, as shown most clearly in FIG. 14, each tooth of the guide plate 36*a* is engaged between adjacent teeth of the toothed blade 31*a* of the first presser punch 31.

An auxiliary chuck arrangement is provided which includes a fixed chuck arrangement member 37, with the auxiliary chuck being disposed adjacent to the second presser punch 32. The fixed chuck member 37 includes a comb-like guide 37*a*. By virtue of these constructional features, the punch block 3 is composed of the cutter punch 30, the two presser punches 31, 32, and the auxiliary chuck member 37, with all of these components being mounted on the punch holder 33.

As matting members for the above-described punches, a cutter die 40, a first presser die 41, and a second presser die 42 are provided, with each of the dies 40, 41, 42 being disposed in opposition to the corresponding punches on the die holder 43, and with the die holder 43 being adapted to be raised and lowered along the pillars 2. By virtue of this arrangement, the cutter section and wire-to-connector assembling sections are located at one place along the body or base 1 of the apparatus thereby enabling a structural compactness and accessibility to every part of the working sections of the apparatus while facilitating the wire-to-connector assemblying work and promoting a mass production of the electrical harnesses. In operation, the first presser punch 31 and first presser die 41 work on one of the abutting terminals of the wires cut to a desired length by the cutter punch 30 and cutter die 40, and the second presser punch 32 and second presser die 42 work on the other of the abutting terminals thereby completing the wire-to-connector assemblying works on the two abutting terminals at the same time. Thus, the procedure of the wire-to-connector assembly is extremely simplified thereby reflecting on the overall total production costs.

Figure 12:
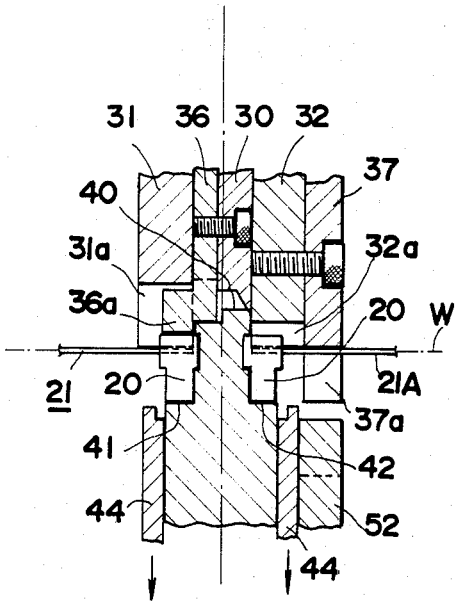
FIG. 12 is a cross sectional detailed view of the dies and punches of FIG. 7 returning to an original position.
Figure 13:
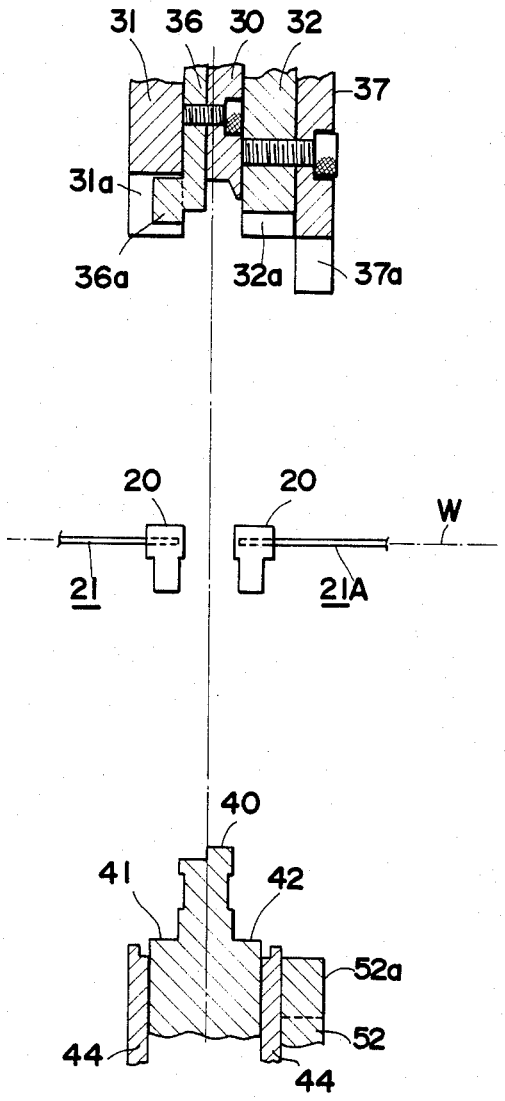
FIG. 13 is a cross sectional detailed view of the dies and punches of FIG. 7 returning to an original position.

A pair of guide plates 44 are provided which are biased or pulled toward each other by the spring 51 and, as shown most clearly in FIG. 4, each plate 44 is, preferably, loosely slidably supported in a guide slot 50. The guide plates 44 are located adjacent to the first and second presser dies 41 and 42, and are vertically moved by means of a hydraulic or pneumatic cylinder 48, with a rod or actuating lever 45 being connected to a piston rod 49 of the cylinder 48. The rod or actuating lever 45 is pivoted to the die holder 43 by a pin 46 and is engaged in a recess or notch 47 provided on the guide plate 44. When the guide plates 44 are in a fully raised position, the guide plates 44 constitute or define walls for the first and second presser dies 41, 42 and, when the guide plates 44 are in a fully lowered or retracted position, the walled space is vacated or opened so as to provide an open space shown most clearly in FIG. 12. The guide plates 44 are intended to prevent the connectors 20 from becoming displaced laterally or sideways on the presser dies 41, 42.

The auxiliary chuck further includes a movable chuck member 52, with the movable chuck member 52 including a comb-like toothed plate 52*a* at its top end adapted to engage with the comb-like guide 37*a* of the chuck member 37. The movable chuck member 52 of the auxiliary chuck member is raised and lowered by a hydraulic or pneumatic cylinder 53 mounted on the die holder 43.

By virtue of the above noted arrangement, the die block 4 is composed of the cutter die 40, the two presser dies 41, 42, and the movable chuck member 52 of the auxiliary chuck, all of which are mounted on the die holder 43, with the die holder 43 being vertically movable by a hydraulic or pneumatic cylinder 10 and a further hydraulic or pneumatic cylinder 54, in an arrangement in which the die holder 43 is connected to the piston rod 12 through a piston rod 55 of the cylinder 54, in the manner shown most clearly in FIG. 1. In this manner, the cutter die 40, the two presser dies 41, 42, and the movable chuck member 52 of the auxiliary chuck are moved by two steps.

The fixed chuck 13, in spite of the implication of its name, is constructed so as to move a slight distance of, for example, a few millimeters, in a direction of the wire feed path W when the chuck 13 conveys the wire group 21' until the terminals thereof are placed at a position where the connectors 20 are affixed to the terminals of the wires 21 by the first and second presser dies 41, 42.

Figure 5:
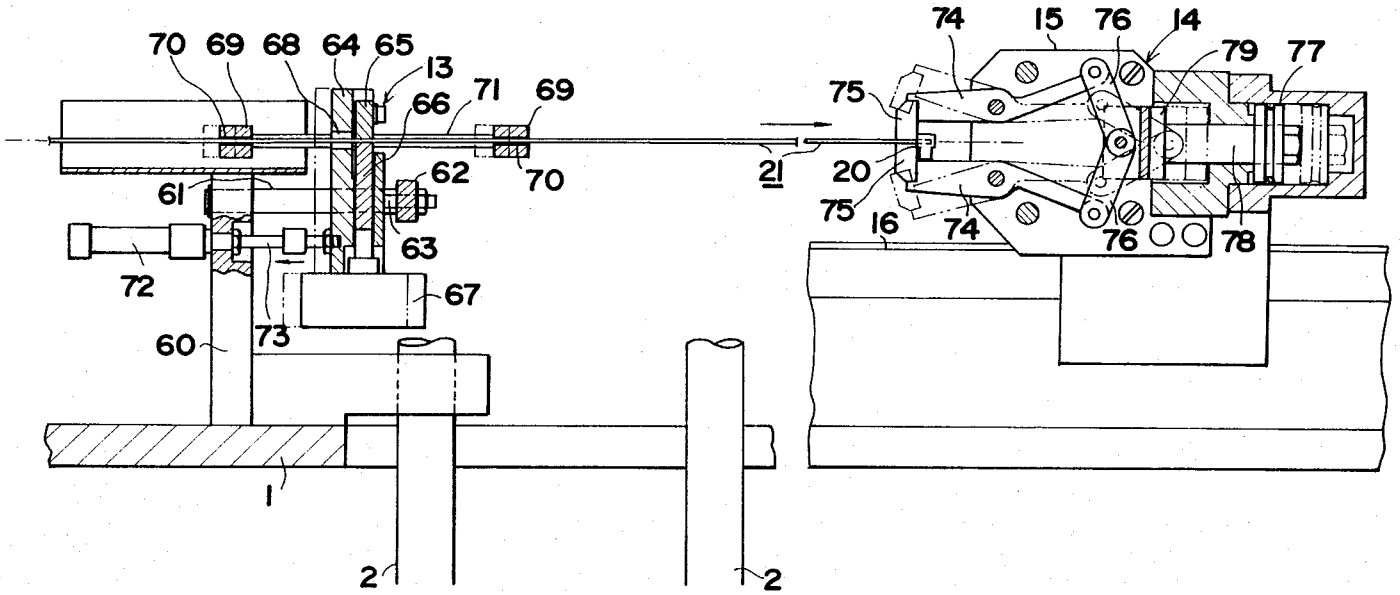
FIG. 5 is a front view, on an enlarged scale, of a fixed chuck and movable chuck working in cooperation to pull wires in the apparatus constructed in accordance with the present invention.

The operation and function of the fixed chuck 13 will be explained in detail in connection with FIG. 5, wherein a post 60 is mounted on the body or base 1, with a pair of supporting arms 61, only one of which is illustrated in FIG. 5, being supported on the post 60. The supporting arms 61 extend along the wire feed path W, with the two arms 61 being united at terminal ends thereof by a plate 62 having provided thereon a stop pin 63. The fixed chuck 13 includes a chuck body 64, a fixed chuck member 65, mounted on an upper part of the chuck body 64, and a movable chuck member 66 located opposite to the fixed chuck member 65. The movable chuck member 66 is adapted to be raised and lowered by a hydraulic or pneumatic cylinder 67 mounted at a lower end of the chuck body 64. The chuck body 64 includes a wire passage 68 through which the wire group 21' is passed, wherein the wires 21 of the wire group 21' are individually spaced in a horizontal plane, and are securely held by the fixed and movable chuck members 65, 66.

A pair of guides 69 are supported on a pair of supports 71, only one of which is illustrated in the drawings, with the supports 71 being mounted on the chuck body 64 in parallel to the wire feed path W for facilitating the feeding of the wire group 21'. Each guide 69 includes a plurality of holes corresponding in number to the number of wires 21 in the wire group 21'. The holes 70 are equally spaced in a horizontal plane so as to prevent the wires 21 from becoming displaced laterally or sideways. In this manner, the wire group 21' is fed in neatly arranged rows in a horizontal plane in a direction or along the wire feed path W.

The chuck body 64 of the fixed chuck 13 is carried on a support 61 in such a manner that the chuck body 64 can be axially moved in the manner shown in phantom lines in FIG. 5. The axial movement of the chuck body 64 is effected by means of a hydrualic or pneumatic cylinder 72 in a construction in which the chuck body 64 is connected to a piston rod 73 of the hydraulic or pneumatic cylinder 72 secured to the post 60. However, the movement of the chuck body 64 is very slight, for example, a few millimeters, and normally the chuck body 64 is placed into abutment with a stop pin 63.

The mating or movable chuck 14 includes a pair of arms 74, with each arm 74 including a nipper 75 at an end portion thereof. Each arm 74 is pivoted on the chuck body 15 at a mid or central portion thereof. Additionally, each arm 74 is pivotally connected to a pivotal length 79 so as to allow the pair of arms 74 as a whole to open and close on the common pivot at which the pivotal links 76 are pivotally joined on a movable bracket 79, with the movable bracket 79 being secured to a piston rod 78 of a hydraulic or pneumatic cylinder 77 mounted on the chuck body 15. The nippers 75 are adapted to be opened or closed in accordance with a direction of movement of the movable bracket 79. As apparent from FIG. 3, by virtue of the relationship of the nippers 75 with the guides 69, with the nippers in an open position, the wires 21 extending along the wire feed path W will be nipped, wherein the wires 21 have the connector 20 positioned at terminal ends thereof. The nippers 75 are arranged such that the wires 21 can be nipped at a point adjacent to the connector 20.

As evident from FIG. 5, the nippers 75 operate in such a manner that when the wires 21 are nipped by the nippers 75 at a point adjacent to the connectors 20, the chuck body 15 is caused to be displaced in a right hand direction along the rail 16 thereby extracting the wire group 21' in a direction of the arrow in FIG. 5. When the wire group 21' is extracted to a desired predetermined length, the extraction of the wire group 21' is stopped and, at this time, the connector-free terminals of the wires 21 of the wire group 21' are located at the cutting and connector assemblying section. Generally, the links of the wire group 21' to be cut depends upon the types of harnesses to be manufactured and there can be many methods for securing the desired length of wires to be incorporated into the harness. According to the present invention, the adjustment of a wire length can be readily performed merely by controlling the extraction of the wire group 21' by means of the movable chuck 14. Unlike previously proposed arrangements, it is not necessary to move the wire-to-connector section and, consequently, the overall procedure is extremely simplified with respect to the wire-to-connector assemblying operations.

Figure 6:
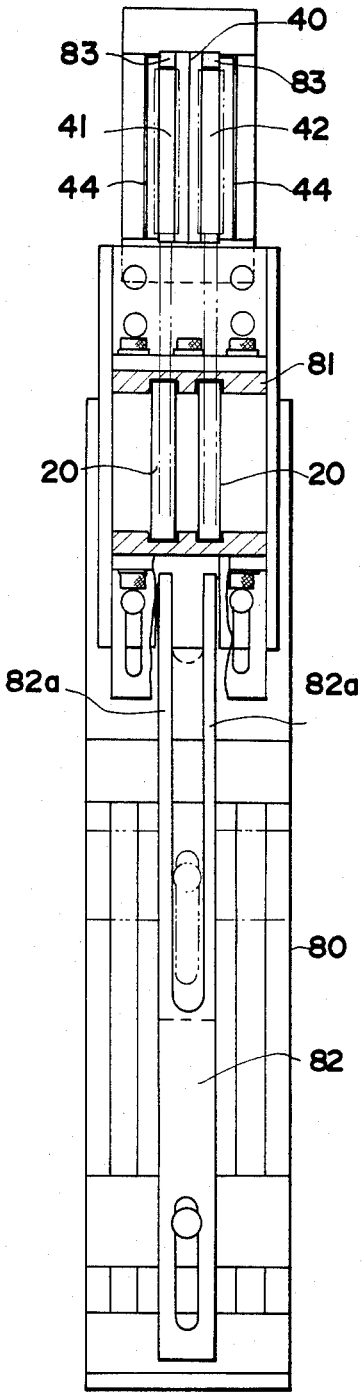
FIG. 6 is a plan view, on an enlarged scale, of a connector supply unit for an apparatus constructed in accordance with the present invention.

FIG. 6 provides an illustration of a connector supply unit 17 and, according to this Figure, the connector supply unit 17 includes a base 80 secured to the machine body or base 1, with the base 80 being disposed or located between the pillars 2. A front portion of the base 80 is adapted to be located adjacent to the dies 40, 41 and 42 when the dies are fully descended or in the lowermost position. A tail portion of the base 80 extends laterally or sideways in a horizontal plane, with the base 80 including a magazine 81 which is vertically provided at the front portion of the base 80. The magazine 81 is adapted to stock a number of connectors 20 in two rows spaced in correspondence to a distance between the first presser die 41 and the second presser die 42. A pusher 82, including fork-shaped rods 82*a*, is reciprocably mounted along the base 80 and is adapted to be reciprocated by a hydraulic or pneumatic cylinder (not shown) in a conventional manner. When the pusher 82 is advanced, the rods 82*a* push the connectors 20 disposed in each row thereby causing the connectors 20 to ride on the first presser die 41 and the second presser die 42. Stop pins 82 are provided and project inwardly of the presser dies 41, 42. When the connectors 20 are supplied in this manner, the guide plates 44 are slightly displaced outwardly against the biasing force of the spring 51 so as to allow the connectors 20 to enter smoothly between the first and second presser dies 41, 42. When the connectors 20 are properly situated in the respective presser dies 41, 42, the guide plates 44 are returned to their original state so as to function as a guide means and, in this manner, a misalingment, misplacement, or displacement of the connectors 20 is effectively prevented.

Figure 7:
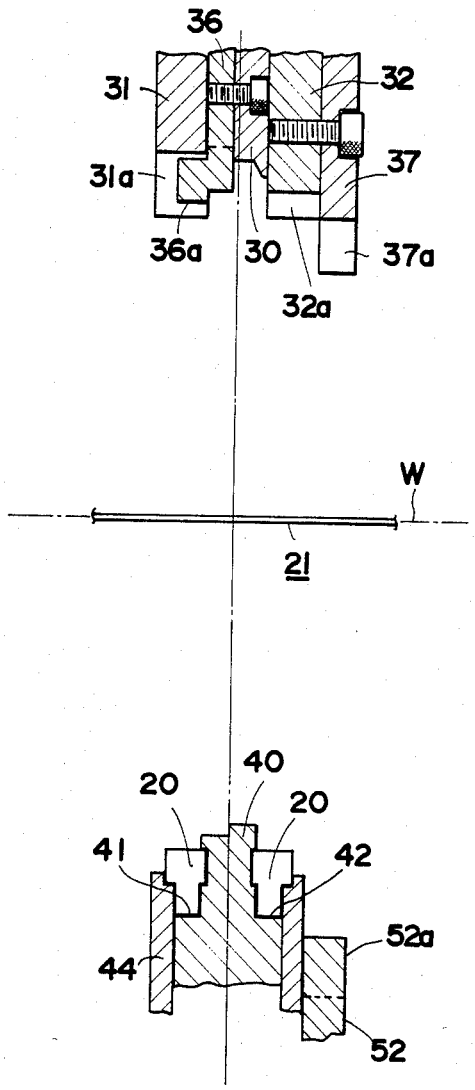
FIG. 7 is a cross sectional detail view, on an enlarged scale, of a position of the punches and dies of the apparatus of the present invention when connectors are supplied from a connector supply unit.
Figure 8:
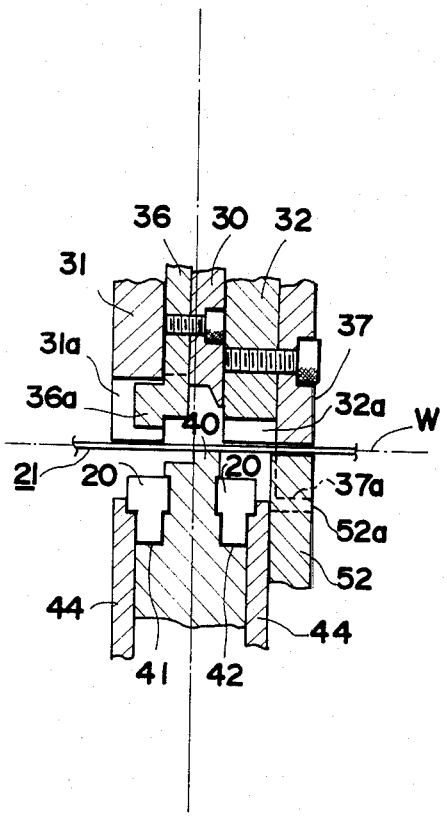
FIG. 8 is a cross sectional detailed view of a position of the punches and dies of FIG. 7 with the dies and punches in abutment.

The apparatus of the present invention operates in the following manner:

The movable chuck 14 is moved to the right in FIG. 5 along the rail 16 in parallel to the wire feed path W, wherein the nippers 75 nip the wires 21 of the wire group 21' having the connectors 20 at their terminals. The connectors 20 have been secured to the terminals of the wire group 21' by the first presser punch 31 and first presser die 41 in a previous operating process. When a desired length of a wire group 21' is extracted by the movable chuck 14, the extraction operation is stopped. At this stage, the punch block 3 is fully ascended or raised and the die block 4 is fully descended or located in its lowermost position and the punches 30, 31, 32 and dies 40, 41, 42 are located in the positions illustrated in FIG. 7. In the illustrated position, the connectors 20 are supplied through the connector supply unit 17 and are placed on the first presser die and second presser die 42.

Then, the hydraulic or pneumatic cylinders 9, 10 are actuated to cause the punch holder 33 to descend and cause the die holder to ascend or be raised. The punch holder 33 descends until the toothed blades 31*a*, 32*a* of the punches 31, 32 are placed in abutment with the wires 21 in the wire group 21'. At the same time, the auxiliary chuck member 37 is equally descended or lowered until its comb-like guide 37*a* is brought into abutment with the individual wires 21. In this manner, the wires 21 are individually caught in the individual indentations of the comb-like guide 37*a* thereby avoiding a lateral displacement of the wires 21. The die holder 43 is raised or ascended until the cutter die 40 comes into abutment with the wire group 21'.

At this stage, the hydraulic or pneumatic cylinder 53 is actuated to cause the auxiliary chuck member 52 to be raised or ascend until its comb-like blade 52*a* comes into abutment with the comb-like guide 37*a*. In this manner, the individual wires 21 are securely caught by the comb-like toothed blade 52*a* and guide 37*a*. Then, the hydraulic or pneumatic cylinder 67 is actuated to cause the movable chuck member 66 to ascend or be raised until the wires 21 are caught by the movable chuck members 65, 66. In this manner, the wire group 21' is held under tension by the fixed chuck 13 and the two auxiliary chuck members 37, 52.

Figure 9:
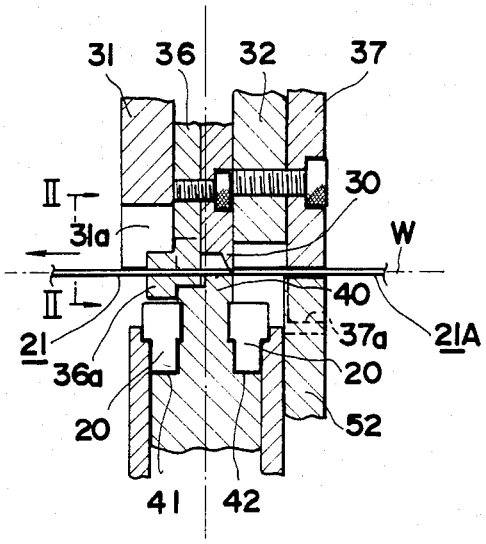
FIG. 9 is a cross sectional detailed view of the punches and dies of FIG. 7 with a cutter punch actuated.
Figure 10:
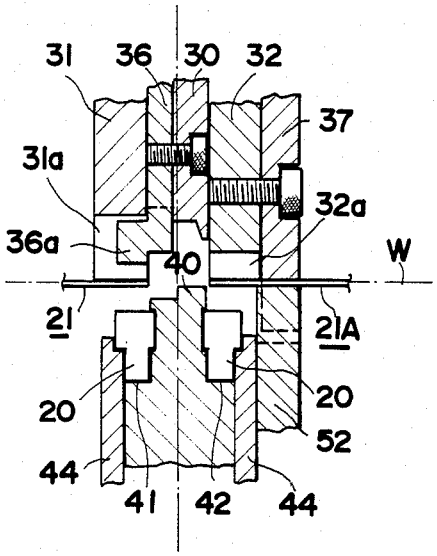
FIG. 10 is a cross sectional detailed view of the dies and punches of FIG. 7 with the wire terminals in positions.

Subsequently, the hydraulic or pneumatic cylinder 34 is actuated to cause the cutter punch 30 to descend to cut the wire group 21' in cooperation with the cutter die 40 in the manner shown most clearly in FIG. 9. By virtue of this action, the wires 21 of the wire group 21' are cut and separated into two wire groups 21' and 21A, with the wire group 21A having a connector at its terminal end which is adapted to be extracted by the movable chuck 14. The wire group 21*a* becomes one unit to be incorporated into one harness. In this cutting process, the wire guide 36 is lowered simultaneously with the cutter punch 30, and guides the wires 21 so they are cut in the proper condition in which they are equally spaced by the teeth 36*a*. In this way, the wires 21 are cut so as to have the terminal ends disposed in alignment. Then the hydraulic or pneumatic cylinders 72 is actuated to cause the fixed chuck 13 to withdraw to a position shown in phantom line in FIG. 5 thereby pulling the wire group 21' separated from the wire group 21*a* in the left hand direction and enabling the terminals of the wire group 21' to be properly located above an inner end of the first presser die as shown FIG. 10.

Figure 11:
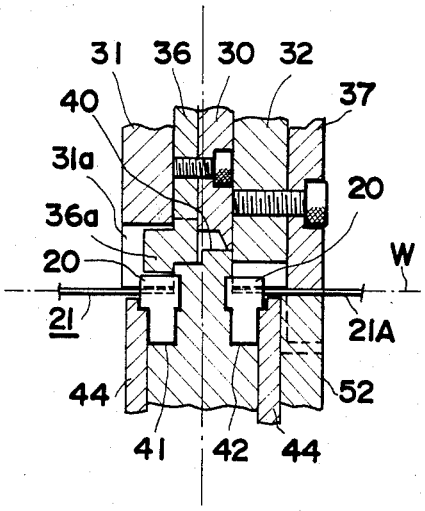
FIG. 11 is a cross sectional detailed view of the dies and punches of FIG. 7 with the cutter punch returned to an original position.

At the next stage of operation, the hydraulic or pneumatic cylinder 34 is deactuated to allow the cutter punch 30 to return to its original position under the action of the spring 35 and, at the same time, the wire guide 36 also returns to its original position. When the cutter punch 30 is raised or ascends and returns to its original position, the hydraulic or pneumatic cylinder 54 is actuated to cause the die holder 43 to further ascend or be raised until the three dies 40, 41, and 42 are located slightly higher than the wire feed path W as shown in FIG. 11. This disposition of the three dies 40, 41, 42 enables the toothed blades 31*a*, 32*a*, of the presser punches 31, 32 to be brought into engagement with the connectors 20 mounted or placed on the presser dies 41, 42.

Figure 15:
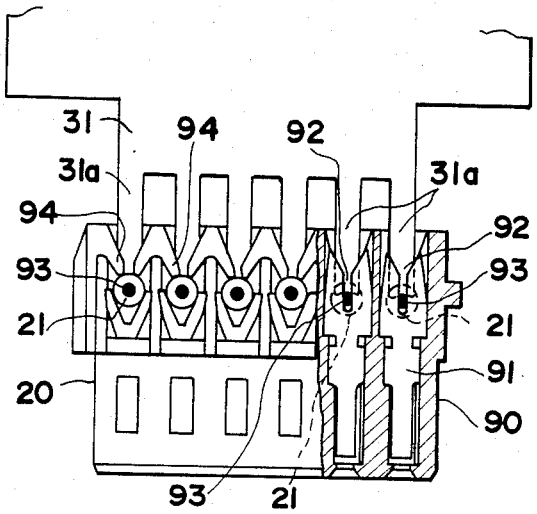
FIG. 15 is a partial cross sectional view illustrating a relationship between the wires and the connectors when the wires are forced into the connector by the apparatus of the present invention.

FIG. 15 provides an illustration of the manner in which the wire-to-connector assembly work is carried out and, according to this figure, the toothed blades 31*a*, 32*a*, of the presser punches 31, 32 are placed or brought into engagement with the connectors 20 located on the presser dies 41, 42, as apparent from FIG. 15; however, attention is directed to the structure of the connector 20 which, as shown in the left hand section of FIG. 15, includes a housing 90 in which a plurality of contacts 91 are housed, with each contact having a slot 92 adapted to receive an insulation clad wire 21. The wires 21 are forced into the slots 92 of the contacts 91 under the pressure provided by the toothed blades 31*a*. The lateral or side ridges of the slots 92 penetrate or extend into the insulation layers of the wires 21, and are brought into abutment with the innermost conductors 93 in the wires 21 thereby achieving an electrical connection between the wires 21 and the connectors 20. A strain relief means is adapted to hold the wires 21 in the housing 90.

The same procedures are simultaneously applied to the connector free terminals of the wire group 21A on the second presser punch 32 and die 42. In this manner, the abutting terminals of the wire groups 21' and 21A are provided with the connectors 20 in the adjacent two wire-to-connector assemblying sections. In the wire-to-connector assemblying process described hereinabove, the movable chuck member 52 of the auxiliary chuck is arranged to automatically descend when the hydraulic or pneumatic cylinder 53 is deactuated thereby avoiding a possible collision with the fixed chuck member 37.

As described hereinabove, the first and second presser punches 31, 32 are caused to descend to a position adjacent the wire group 21' whose terminal ends are aligned along a level of the wire feed path W; whereas, the first and second presser dies 41, 42 are caused to ascend until they slightly exceed or are disposed above the wire feed path W. In this manner, the individual wires 21 come into engagement with the connectors 20 disposed or placed on the first and second dies 41, 42. It will be appreciated from this that the wire group 21' is maintained motionless throughout the wire-to-connector assemblying work thereby ensuring that the individual wires 20 are securely recieved in the individual contacts or connectors 20 without the possibility of a lateral or sideways displacement.

This is tremendously advantageous as compared with previously proposed practices wherein the connectors 20 are kept motionless whereas the wires 21 are moved to the connectors 20. As is known, the wires 21 are flexible and tend to make a loop and such a difficult nature of the wire 21 is likely to cause a misalignment, misplacement, and/or a disengaging of the wire 21 with respect to the connectors 20. However, by virtue of the features of the present invention, such troubles can effectively be avoided. Another advantage of the present invention resides in the fact that the wires 21 can be of a relatively short length and yet be effectively treated or handled.

When the wire-to-connector assemblying work or operation is finished, the hydraulic or pneumatic cylinder 48 (FIG. 4) is actuated to cause the rod 45 to rotate in a counterclockwise direction thereby allowing the guide plates to be lowered. Simultaneously, the hydraulic or pneumatic cylinder 53 is actuated to cause the movable chuck member 52 of the auxiliary chuck to further descend thereby vacating or opening an outside of the first and second presser dies 41, 42. Then, the hydraulic or pneumatic cylinders 9, 10 are actuated to cause the punch block to ascend or be raised and case the die block 4 to be lowered. In this manner, the punchs 30, 31, and 32 and the dies 40, 41, and 42 respectively return to the original positions illustrated in FIG. 7. At this stage, the connectors 20 secure to the terminal ends of the wire groups 21', 21A are released from the respective dies 41, 42. Finally, the hydraulic or pneumatic cylinder 48 is actuated to cause the guide plates 44 to return to their original positions.

Figure 16:
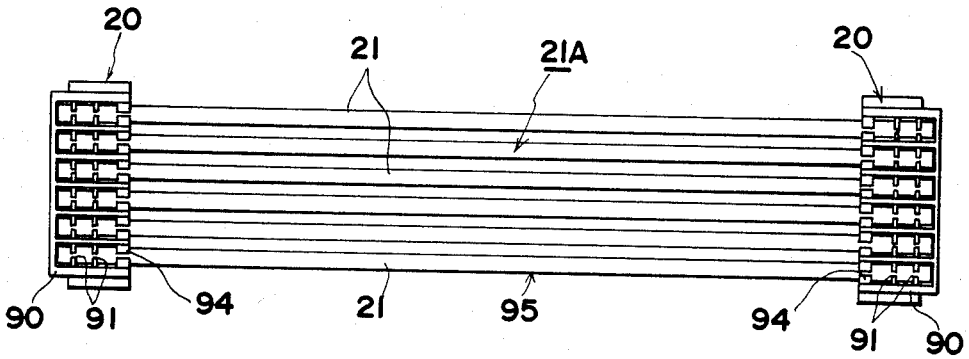
FIG. 16 is a plan view of a finished harness produced by the apparatus of the present invention.

As shown in FIG. 16, a finished harness generally designated by the reference numeral 95 includes a wire group 21A and connectors 20 secured to both terminal ends. In a final process, the harness 95 is still engaged by the movable chuck 14 at one end and is shifted up to a desired position. The finished harness 95 is released into a receiver 19 (FIG. 1) by means of a hydrualic or pneumatic cylinder 18.

In the embodiment described hereinabove, the connectors 20 secured to the terminal ends of the wire group 21' are released by the guide plates 44 which is adapted to be raised and lowered along the lateral sides of the first and second presser dies 41, 42. However, the invention is not limited to this construction but, for example, a knockout punch or pusher (not shown) may be employed in lieu of the guide plates 44. Moreover, while the above described embodiment relates to wires of a discrete wires, it is understood that the wires may also be ribbon wires.

While we have shown and described only one embodiment in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. An apparatus for making electrical harnesses that include wires and electrical connector means, the apparatus comprising:

a wire feed path extending substantially horizontally and axially of the apparatus;

cutter means disposed on opposite sides of the wire feed path for cutting wires fed along the wire feed path into a first and second group of wires having terminal ends adjacent the cutter means;

a first assembly means arranged on respective sides of the wire path adjacent one side of said cutter means for assemblying the terminal end of said first group of wires to electrical connector means;

a second assembly means arranged on respective sides of the wire path adjacent a side of the cutter means opposite the first assembly means for assemblying the terminal ends of the second group of wires to electrical connector means;

means for supplying electrical connector means to said first and second assembly means;

a substantially fixed chuck means disposed adjacent said first assembly means for equally spaced guiding of the wires to a position adjacent the cutter means;

a further chuck means mounted for movement along said wire feed path for extracting wires from a point adjacent the cutting means for a distance corresponding to a desired length of the electrical harness;

means for actuating said first and second assembly means whereby the terminal ends of the first group of wires and second group of wires are assembled to the electrical connector means by the first and second assembly means in a single assemblying operation; and guide means arranged along outer sides of said first and second assembly means for guiding the electrical connector means therein, means are provided for selectively raising and lower said guide means, said guide means in a raised position defining a guide wall for guiding the first and second assembly means and, in a lower position, providing access to the first and second assembly means.

2. An apparatus according to claim 1, wherein said guide means includes a pair of guide plates disposed along outer sides of the first presser die and the second presser die, said pair of guide plates being adapted to be unitarily moved in a direction toward the first presser punch and the second presser punch and to be displaced away from the first and second presser punches when the assemblying operation is completed.

3. An apparatus according to claim 1, further comprising auxiliary chuck means disposed adjacent said second assembly means for holding the wires at equal spacing in a proper condition so as to prevent the wires from being laterally displaced, said auxiliary chuck means being connected to the second assembly means for movement therewith.

4. An apparatus according to claim 3, further comprising means for discharging a finished electrical harness from the apparatus to a receiver means.

5. An apparatus according to claim 4, wherein said guide means are displaced to a lower position upon a completion of an assemblying operation by the first and second assembly means, and wherein the cutter means, first assembly means, and second assembly means are interconnected so as to assume a release position upon a termination of the assemblying operation so as to enable a release of the finished electrical harness by the discharging means.

6. An apparatus according to one of claims 3, 4, or 5, wherein the first assembly means includes a first presser punch disposed on one side of the wire feed path and a first presser die opposite the first presser punch disposed on the other side of the wire feed path, the second assembly means includes a second presser punch disposed on one side of the wire feed path and a second presser die opposite the second presser punch disposed on the other side of the wire path, said first and second presser punches being adapted to be displaced to a position at which the wires are cut and separated into the two groups by the cutter means, the means for supplying are adapted to feed the electrical connector means to the first presser die and second presser die, and wherein the first and second presser dies are adapted to be displaced to a position beyond the wire feed path so as to enable the electrical connector means in the respective dies to be brought into engagement with the individual wires of the first and second groups of wires thereby forcing the individual wires into engagement with a contact accommodated in the electrical connector means.

7. An apparatus according to claim 6, wherein said guide means includes a pair of guide plates disposed along outer sides of the first presser die and the second presser die, said pair of guide plates being adapted to be unitarily moved in a direction toward the first presser punch and the second presser punch and to be displaced away from the first and second presser punches when the assemblying operation is completed.

8. An apparatus according to claim 7, wherein said cutter means includes a cutter punch disposed on one side of the wire feed path and an opposed cutter die disposed on an opposite side of the wire feed path, said cutter punch, said first presser punch, and said second presser punch are disposed above the wire feed path and said first presser die and said second presser die are disposed below the wire feed path, and wherein said cutter means, first presser punch and second presser punch are adapted to be raised while the cutter die, first presser die, and second presser die are lowered following a completion of the assemblying operation so as to allow the wires and assembled electrical connector means at both terminal ends there of to be released as a finished harness.

9. An apparatus according to claim 8, wherein the auxiliary chuck means includes a pair of auxiliary chuck members, one of said auxiliary chuck members being disposed adjacent the second presser die and the other of said auxiliary chuck members being disposed adjacent the second presser punch, said pair of auxiliary chuck members being respectively connected to said second presser punch and said second presser die for movement therewith.

10. An apparatus according to claim 1, wherein said guide means are displaced to a lower position upon a completion of an assemblying operation by the first and second assembly means, and wherein the cutter means, first assembly means, and second assembly means are interconnected so as to assume a release position upon a termination of the assemblying operation so as to enable a release of the finished electrical harness by the discharging means.

11. An apparatus according to claim 1, wherein the first assembly means includes a first presser punch disposed on on side of the wire feed path and a first presser die opposite the first presser punch disposed on the other side of the wire feed path the second assembly means includes a second presser punch disposed on one side of the wire feed path and a second preser die opposite the second presser punch disposed on the other side of the wire path, said first and second presser punches being adapted to be displaced to a position at which the wires are cut and separated into the two groups by the cutter means, the means for supplying are adapted to feed the electrical connector means to the first presser die and second presser die, and wherein the first and second presser dies are adapted to be displaced to a position beyond the wire feed path so as to enable the electrical connector means in the respective dies to be brought into engagement with the individual wires of the first and second groups of wires thereby forcing the individual wires into engagement with a contact accommodated in the electric connector means.

* * * * *